US011085185B2

(12) United States Patent
Jaramillo Peralta et al.

(10) Patent No.: US 11,085,185 B2
(45) Date of Patent: Aug. 10, 2021

(54) MODULAR PANEL SYSTEM AND A WALL INSTALLATION METHOD

(71) Applicant: QCLASS S.A., Santiago (CL)

(72) Inventors: Pablo Jaramillo Peralta, Santiago (CL); Guillermo Guevara Guzmán, Santiago (CL); Dusan Gardilcic Benito, Santiago (CL)

(73) Assignee: QCLASS S.A., Santiago (CL)

( * ) Notice: Subject to any disclaimer, the term of this patent is extended or adjusted under 35 U.S.C. 154(b) by 47 days.

(21) Appl. No.: 16/494,070

(22) PCT Filed: Oct. 22, 2018

(86) PCT No.: PCT/IB2018/058213
§ 371 (c)(1),
(2) Date: Sep. 13, 2019

(87) PCT Pub. No.: WO2020/084327
PCT Pub. Date: Apr. 30, 2020

(65) Prior Publication Data

US 2021/0054626 A1 Feb. 25, 2021

(51) Int. Cl.
*E04B 2/78* (2006.01)
*E04B 2/74* (2006.01)
*E04C 2/34* (2006.01)

(52) U.S. Cl.
CPC ..... *E04B 2/7457* (2013.01); *E04B 2/7425* (2013.01); *E04B 2/78* (2013.01); *E04B 2002/7461* (2013.01); *E04B 2002/7498* (2013.01); *E04C 2/34* (2013.01)

(58) Field of Classification Search
CPC ..... E04B 2/7457; E04B 2/7425; E04B 2/78; E04B 2002/7461; E04B 2002/7498; E04C 2/34
USPC ..... 52/261, 268, 269, 271, 276, 277, 278, 52/279, 255, 256, 287.1
See application file for complete search history.

(56) References Cited

U.S. PATENT DOCUMENTS 2,121,213 A * 6/1938 Small ..... E04F 19/06 52/277
2,656,064 A * 10/1953 Bues ..... B65D 7/12 220/4.01

(Continued)

FOREIGN PATENT DOCUMENTS

CN 105569229 A 5/2016
FR 2826386 A1 12/2002

(Continued)

*Primary Examiner* — Brent W Herring
(74) *Attorney, Agent, or Firm* — Berenato & White, LLC

(57) ABSTRACT

The present invention relates to the construction industry, and in particular to laboratories, hospitals, food production areas and other places where asepsis is required. Specifically, it relates to a modular construction system based on self-supporting panels, which have post-formed exterior surfaces and are complemented with corner components of similar construction to build hermetic, waterproof and insulating walls that have smooth surfaces. For this, there is a modular system of panels for forming aseptic spaces within an enclosure and a method of installing a clean room wall by means of a modular system of panels to form aseptic spaces inside an enclosure.

14 Claims, 5 Drawing Sheets

(56) References Cited

U.S. PATENT DOCUMENTS

| | | | | | |
|---|---|---|---|---|---|
| 3,074,521 | A * | 1/1963 | Woods | F24D 19/04 | 52/288.1 |
| 4,893,447 | A * | 1/1990 | Opp | E04H 3/10 | 52/287.1 |
| 5,256,105 | A | 10/1993 | Austin | | |
| 6,070,377 | A | 6/2000 | Guevara Guzman | | |
| 7,748,182 | B2 * | 7/2010 | McGee | E04F 13/0805 | 52/287.1 |
| 2006/0107606 | A1 * | 5/2006 | Remelts | E04B 2/7425 | 52/204.1 |
| 2016/0160510 | A1 * | 6/2016 | O'Brien | E04F 19/0477 | 52/287.1 |

FOREIGN PATENT DOCUMENTS

| | | | |
|---|---|---|---|
| FR | 2899257 | A1 | 10/2007 |
| JP | 2012036623 | A | 2/2012 |
| WO | WO2006000320 | A1 | 1/2006 |

* cited by examiner

MODULAR PANEL SYSTEM AND A WALL INSTALLATION METHOD

CROSS-REFERENCE TO RELATED APPLICATIONS AND CLAIM TO PRIORITY

This application is a national stage application of International Application No. PCT/IB2018/058213 filed Oct. 22, 2018 the disclosures of which are incorporated herein by reference and to which priority is claimed.

FIELD OF THE INVENTION

The invention relates to construction industry, and in particular to laboratories, hospitals clean areas and food production areas that are required asepsis. The present invention specifically relates to a modular construction system based on self-supporting panels, those that have post-formed exterior surfaces and are complemented with corner components of similar construction to build hermetic, waterproof and insulating walls that have smooth surfaces.

BACKGROUND OF THE INVENTION

Clean rooms are spaces that meet certain requirements related to the maintenance of asepsis. These spaces are necessary inside industrial, hospital or laboratory enclosures, among others, which are intended for example for the manufacture or preparation of food, drugs, clinical care, specimen collection, etc. There are general rules for these sterilized spaces, where the interior walls must allow an easy cleaning, specifically on the critical areas it is indicated that they must be perfectly smooth, washable and sterilizable, so it follows that they should not have protrusions and discontinuities, eliminating living corners in the joints between walls, between them and the ceiling, and between them and the floor; and the closures must have good sealing and be constructed of insulating materials, and in sterile areas it is convenient that they be perfectly tight and that they have neither incoming nor outgoing.

Currently, the use of panels for forming interior walls of clean rooms is known. By means of which, with the problems addressed by a clean room, the search to provide constructive flexibility, cost reduction, resistance of surfaces to washing and continuous disinfection without deterioration, providing durability over time, etc.

In addition, the use of coatings or treatments that are applied to the walls and interior walls of places destined to form clean rooms is known. This through specific interventions or additional facilities that are typically justified to ensure impermeability against polluting agents.

One of these marketed panels was described in U.S. Pat. No. 5,256,105 as a clean room and more particularly to a modularly constructed clean room in which there are no edges between adjoining modules, between the floor and side walls or between the side walls and ceiling. To achieve this, the invention eliminates joints or edges, between the side walls and the floor, and between the side walls and ceiling by placing a rounded broadening molding at each corner, which joins smoothly with the side walls, floor and ceiling. These moldings provide a smooth and tangential transition from the flat surfaces to the rounded widening surface, without the presence of edges, to avoid the accumulation of dust, moisture, etc. Also, a durable coating is applied to the floor, walls and ceiling to form a continuous internal surface without edges. One of the most commonly used coatings is an epoxy paint with antibacterial agent.

Another related alternative, specifically with panels, is described in the international application WO2006000320 as a prefabricated wall system for building environments with a high degree of sterility, particularly operating rooms, which includes at least one self-supporting panel comprising a first sheet of solid surface material consisting of approximately ⅓ of acrylic resin and approximately ⅔ of mineral substances such as aluminum trihydrate, where this surface material is known under the trademarks Corian AB or HI-MACS. In addition, said panel comprises a second metal sheet which will have the same dimension as the first sheet and which is fixed to said first sheet through an elastomeric adhesive.

The configuration described in U.S. Pat. No. 6,070,377 overcomes the drawbacks of living corners, because, used rectangular parallelepiped panels, formed by two exterior covering sheets or larger parallel faces of each other, of variable rectangular proportion according to various combinations of height and length for each work, made of fiberglass, as well as top, bottom and lateral faces, which results in flame retardant surfaces, eliminating oxidation problems, achieving high resistance to chemical agents that cause deterioration due to frequent washing, and are resistant and waterproof surfaces, perfectly polished and smooth, which can also be plasticized or painted with epoxy resins. These panels have concave raised upper and lower edges, which increase the width of the upper and lower faces, and define arcs of outstanding curvature in the respective upper and lower sections of each major face; said arcs of curvature are of cross section corresponding to a quarter of circumference, and end in a small convex counter curvature, which in turn is connected to the corresponding upper or lower face of the panel.

This last panel, of rectangular parallelepiped shape and owned by the same applicant of the present invention, is constituted by two outer cladding sheets made of fiberglass. Due to the specific characteristics of the fiberglass, the manufacturing of this cladding sheets is manual, an operator is in charge of the hand molding of the sheet, also configuring the concave shape of its lower and upper edges.

As soon as a fiberglass sheet is molded by one or more operators, disadvantages are observed such that the quality of the sheet will depend on the skill acquired by the operator and that low levels of sheet production are achieved. In addition, if necessary, to ensure that the outer faces of these sheets have smooth and impermeable surfaces, they should be plasticized or painted with epoxy resins, by hand or by spray.

In addition, the panels made with these fiberglass sheets are not always equal to each other, which makes it difficult to obtain a uniform joint between panels in the building of a clean room and, therefore, an on-site work must be done to ensure that the surfaces maintain a smooth transition between adjacent panels, for this the sides or joints of the sheets of both panels are sanded with tools and/or manually, in order to achieve that they join without irregularities. The building of clean room with large areas with manual manufacturing panels is a big problem, because there are very high delay times and costs, so these projects are discarded, limiting the use of these panels to the manufacturing of clean rooms with surfaces less than 500 $m^2$.

Another disadvantageous aspect of the prior art, are manufactured for a specific room have a defined height that will not necessarily be compatible with other panels, which makes it difficult to maintain, for example, stock of panels for future extensions or necessary fixes will be expeditiously and without incurring in higher costs. In addition, this prior art uses highly toxic materials, which involve the generation of waste with a poor environmental mitigation capability, such as suspended glass fiber or the solvents used, causing for example lung problems in the operators.

Regarding to the prior art, the present invention allows to obtain a modular panel with post-formed outer surfaces, wherein said surfaces, being molded through post-forming, allow to make series of dimensionally equal panels with smooth surfaces and that allow a uniform connection between adjacent panels, independent of the skill of the operator and without the need for in-situ work, such as polishing, plasticizing or painting the internal surface.

SUMMARY DESCRIPTION OF THE INVENTION

The present invention discloses a modular construction system based on panels that include post-formed plastic covers that provide strength and perfectly smooth, washable and sterilizable surfaces. Therefore, the exterior surface of the panels ensures that aseptic problems are eliminated and a better resistance to chemical agents that cause deterioration due to frequent washing is achieved. In addition, the post-forming process used allows to increase the level of panel production and eliminates the need to plasticize or paint their surface once installed to comply with the specific sanitary characteristics of the panel.

The panel includes a perimeter profile with a continuous central groove, which together with the flat surfaces of the post-formed roofs confines a filling material with which thermal, acoustic insulation or some other required characteristic can be obtained.

The upper edges with concave curvature are incorporated in a monolithic upper portion of the panel, while the concave lower edges are obtained as part of a system for fixing the panels to the floor by means of a series of profiles, allowing a simple and safe assembly and also delivery flexibility with respect to the total height of the panel to be installed.

Aside assembly system is included which, unlike the one described in the prior art, comprises female panels and, between each of them, a connection that acts as a male for both sides. In this way, all the panels are successively fitted until a continuous smooth surface wall is formed, according to the dimensions required for each particular work, subsequently the joints between the panels and the connection are sealed together, for example, with white silicone, or preferably with neutral silicone without polyurethane which makes them waterproof, hermetic and insulating.

Thus, these panels with post-formed roofs provide perfectly hermetic walls, and manage to eliminate living corners and leaks between roof, panels and floor, thus avoiding hygiene problems.

In addition, intersection pieces that make rounded corners are incorporated, so that the living corners between walls are avoided and different combinations in the distribution of walls are achieved.

By means of some modifications the panels can incorporate general installations such as electricity, water, oxygen, gas, compressed air, etc., in others, door closures and thermal windows, flush with the smooth surfaces of the panels.

BRIEF DESCRIPTION OF THE DRAWINGS

For a better explanation of the invention, a description will be made of a preferred embodiment, in relation to the illustrative and non-restrictive figures, wherein.

DETAILED DESCRIPTION OF THE INVENTION

Figure 2:
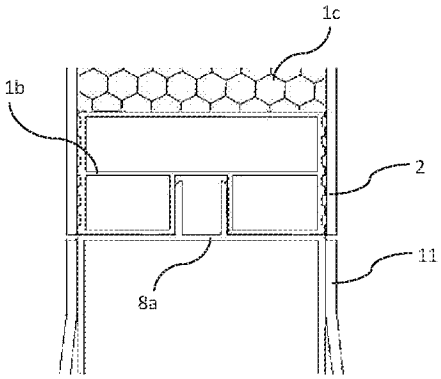
FIG. 2 shows a detailed view of the previous view, illustrating the assembly between the panel and the intermediate support profile.

In an important aspect of the invention, post-formed covers for the main surfaces of the panels are included, where said covers have sterile and waterproofing characteristics and that by their smooth shape allow them to be washable and sterilizable. Wherein, the post-forming of the covers implies that their configuration is achieved through the application of heat and pressure on a sheet against a mold. The material in which the covers are manufactured is generally plastic, compatible with post-forming process and with the hygiene requirements of the clean room, considering, but not limited to, materials such as acrylonitrile butadiene styrene (ABS), polymethyl methacrylate (PMMA), glass or carbon fibers bathed in thermosetting resins.

Hereinafter, the panel (1) is identified as the upper portion of the modular panel, which is integral or monolithic. The panel (1) has a rectangular parallelepiped shape, with larger faces corresponding, each, to a flat wall surface (2) that extends into a curved-concave surface (4) upon reaching the upper edges of the panel (1). The curved-concave surfaces (4) define arcs of protruding curvature of cross section corresponding to a quarter of circumference and end in a small convex counter-curvature. Said counter-curvature in turn connects to the panel upper edge surface (3).

Figure 1:
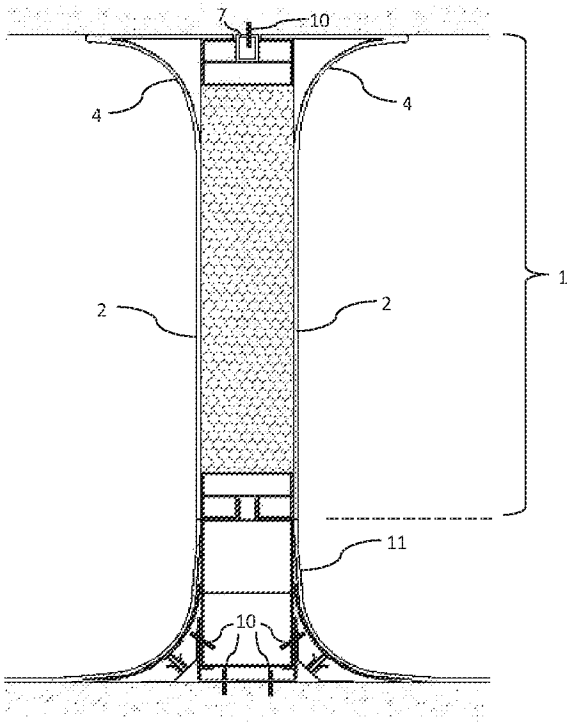
FIG. 1 shows a vertical sectional view of the panel mounted with its complementary components according to the present invention.

In FIG. 1, in a cross-sectional view, the present modular panel installed between the sky and the floor of an enclosure is shown. Which, to form the interior walls of a clean room, of a defined height, includes the panel (1) mounted together with support profiles (8*a*, 8*b*, 9*b*), concave curvature profiles (9*a*) and the upper guide profile (7). FIG. 2 shows the assembly between the panel (1) and the intermediate support perimeter profile (1*b*), in addition to the encounter between the flat wall surface (2) on each side of the panel and the floor cover (11).

An advantageous feature of this configuration is that the same panel is used for enclosures of different heights, which is achieved by varying the height of the intermediate support profile (8*a*), which can be manufactured in a range of sizes, and even resized before transporting to the assembly site, to cover a wide spectrum of total panel height.

All profiles must be made of a material that resists the mechanical stresses and hygiene requirements of the clean room, considering but not limited to materials such as aluminum and PVC.

The panel (1) is developed in an industrialized manner and then transported together with the profiles mentioned above to the assembly site. During the work, elements of fastening of the state of the art are used, whose positions are indicated in FIG. 1, without the need for dimensional adjustments or application of paints or coatings, beyond the sealing of joints between adjacent panels.

Figure 4:
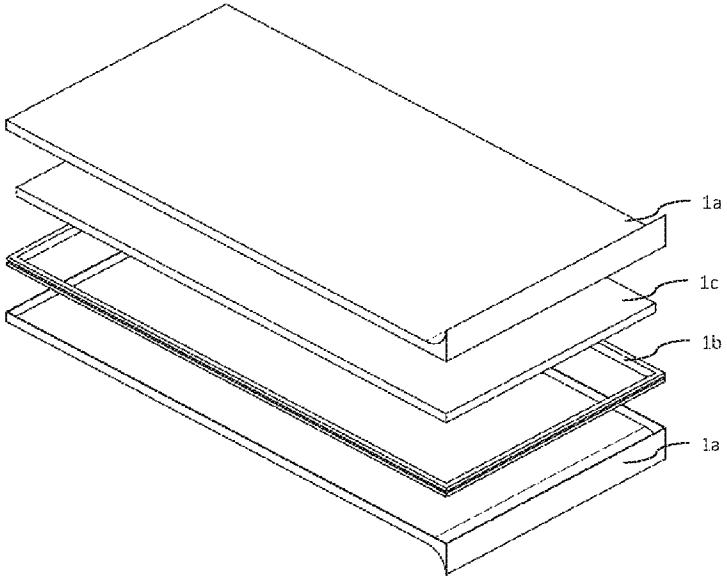
FIG. 4 shows an exploded perspective view of the panel, in its monolithic portion.
Figure 3A:
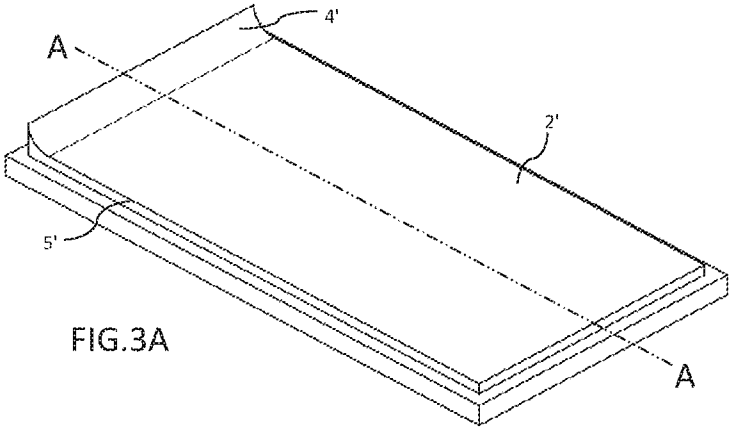
FIGS. 3A and 3B show, respectively, perspective and sectional views along line A-A of a mold for post-forming a half cover to cover a panel.
Figure 3B:
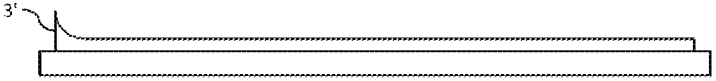

In particular, the elaboration of the panel (1), with reference to FIGS. 3A, 3B and 4, is carried out by means of a procedure that includes the post-forming of shells using a mold such as FIGS. 3A and 3B. The plastic material used in the process must allow adequate levels of mechanical resistance and surface finish to a clean room. Subsequently, said post-formed shells are roughed so as to preserve the surfaces corresponding to the flat portion (2'), the upper edge portion (3') and the curved-concave portion (4'), and the corresponding ones can also be preserved to the lateral edge portions (5) of the mold, thereby obtaining a half cover (1*a*) for each main face of the panel (1).

In the exploded view of FIG. 4, the component parts of the panel (1) are presented, which from the upper level to the lower level correspond to: a cover half (1*a*), the filler material (1*c*), the perimeter profile (1*b*) and another half of cover (1*a*) in the opposite direction to the first. Once the panel (1) is assembled, the filler material (1*c*) is confined within the perimeter profile (1*b*) and between both cover halves (1*a*). The filling material of the panel depends on the insulation requirements and may include without restriction any materials such as polyurethane, aluminum honeycomb and mineral wool.

Figure 5:
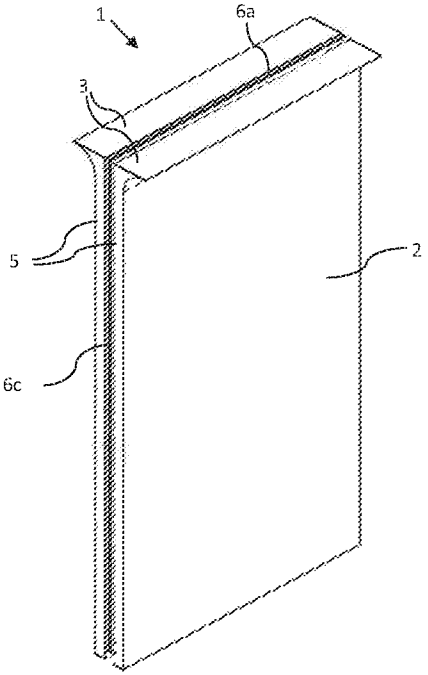
FIG. 5 shows a perspective view of the panel, in its monolithic portion.

The perspective view of the panel (1) presented in FIG. 5 shows that the lateral edge surface (5) and the upper edge surface (3) reveal at least part of the perimeter profile (1*b*), and in particular grooved grooves. In effect, the panel (1) has said groove that extends through the sections indicated as upper (6*a*), bottom (6*b*) and lateral groove (6*c*) along the corresponding edge surfaces.

The upper (6*a*) and bottom (6*b*) grooved grooves are arranged so that during assembly a panel (1) can slide between the upper guide profile (7) and the projections on the upper edge of the intermediate support profile (8*a*).

Figure 6B:
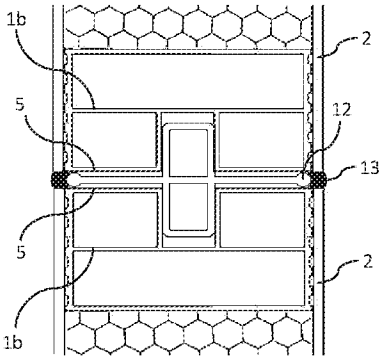
FIGS. 6A and 6B show, respectively, assembly and exploded view of the horizontal section of a joint between adjacent panels according to the present invention.
Figure 6A:
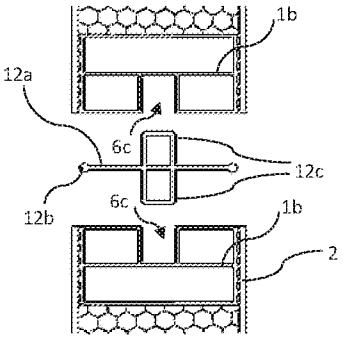

On the other hand, with reference to FIGS. 6A and 6B, each lateral grooved groove (6*c*) allows the fitting with a central projection (12*c*) of a connection profile (12) to join adjacent panels.

The preferred embodiment of the connection profile (12), presented more clearly in FIG. 6A, comprises a flexible strip (12*a*) having raised edges (12*b*) and central projections (12*c*) that extend along the flexible strip and symmetrically with respect to the plane of it. In addition, the width of the flexible strip (12*a*) is smaller than the separation distance of the flat wall surfaces (2) of the panel (1) and the thickness or height of its raised edges (12*b*) is equal to the spacing required to form an optimal sealed joint (13) between adjacent panels. That is, the dimension of the raised edges (for example, the diameter in case of being circular), is equal to the required spacing between panels to offer optimal conditions for the subsequent application of a product for sealing joints, for example, silicone liquid, or other product appropriate to the sanitary requirements of the use of the clean room.

As for the corner encounters, a monolithic corner with a concave and a convex side is defined, which similarly to the panel (1), has a post-formed concave corner and convex corner covers and an edge profile laterals of cross section equal to the perimeter profile (1*b*) formed in perpendicular planes that includes a central groove identical to that of the panel (1). In this way, the union with the panels (1) follows the methodology set forth above, which uses the connection profile (12) and subsequent formation of a sealed joint (13).

Figure 7:
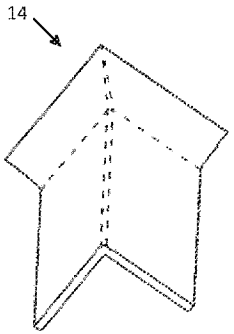
FIG. 7 shows a perspective view from below of a convex corner post-formed cover, where the dotted lines indicate zones of curvature change without joints.

FIG. 7 shows a post-shaped convex corner cover in a lower perspective. Note that, as in the case of the panel (1), this cover includes widening with curvature when it reaches each upper edge, and in the encounter of said widening, it presents a transition with a variable radius of curvature.

Figure 8:
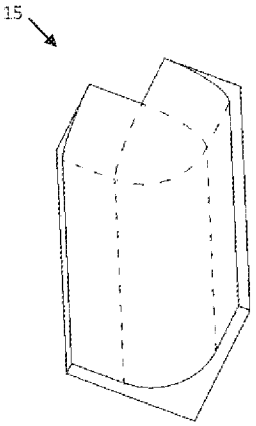
FIG. 8 shows a view similar to the previous one for a concave corner post-shaped cover.

Similarly, a concave corner post-shaped cover is shown in FIG. 8. The one that also has widening with curvature when it reaches each upper edge, but this case in the encounter of the planes has a spherical curvature surface. Note that in FIGS. 7 and 8 the dotted lines indicate zones of change of curvature without joints.

Figure 9:
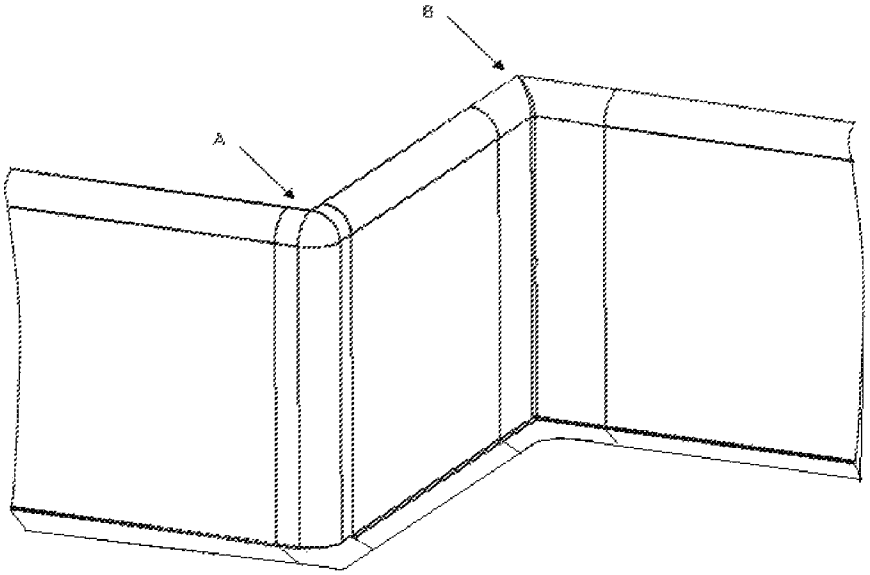
FIG. 9 shows a perspective view from below of the junction of three post-formed cover halves in different planes and interspersed with a concave corner post-formed cover (indicated by arrow A) and a convex corner post-formed cover (indicated by arrow B).

To present the previous corners in context, FIG. 9 is included, which also shows a bottom perspective view, and includes three panel covers in different interleaved planes with a post-shaped concave corner cover (indicated by arrow A) and a post-shaped convex corner cover (indicated by arrow B). We have included arrows A and B to clarify the view since otherwise misinterpretations may occur due to the optics.

The following two figures seek to highlight the advantages of surface termination of the present technology with respect to the traditional solution in which the curvatures are resolved in the cleanroom industry when the panels are straight. For this purpose, the comparison of the number of junction lines exposed in a concave corner at the sky level is made.

Figure 10:
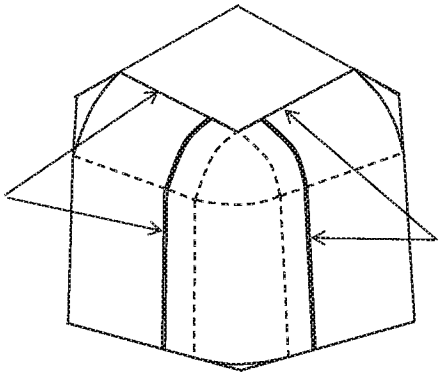
FIG. 10 depicts the termination of a concave corner of a clean room at the sky level according to the present invention, where the dotted lines indicate zones of curvature change without joints.

FIG. 10 represents a concave corner obtained by the present technology, which incorporates a concave monolithic corner spliced with panels mounted on each side, and where the dotted lines indicate zones of curvature change without joints. The arrows emphasize the location of the 4 lines or joints, of which those vertically oriented are sealed during the assembly process.

Figure 11:
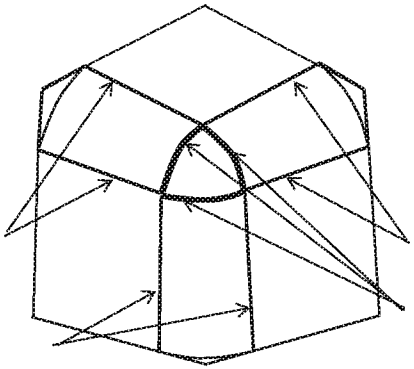
FIG. 11 (Prior Art)
FIG. 11 depicts the termination of a concave corner of a clean room at the sky level obtained by prior art technology.

On the other hand, FIG. 11 represents the termination of a concave corner of a clean room at the sky level, obtained by means of prior art technology, in which four pieces with concave surfaces converge at the corner of the corner, generating nine lines or joints that are emphasized by arrows.

Figure 12:
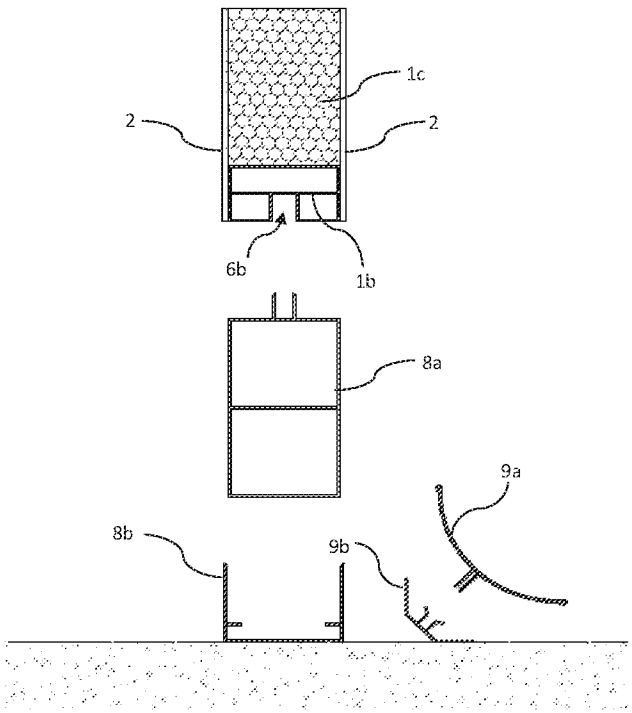
FIG. 12 is an exploded vertical view showing the bottom edge of the panel and the profiles that allow it to be fixed to the floor and incorporate the concave curves in the encounter with the floor.

Finally, FIG. 12 is an exploded view that will allow to describe more clearly the assembly process of the modular panel, in particular of the profiles that allow positioning the lower edge of the panel (1) with respect to the floor and incorporate the concave curvature widening in the encounter with the floor.

Consistent with the foregoing, an embodiment of the present invention relates to a modular system of panels for forming aseptic spaces within an enclosure, which comprises a rectangular parallelepiped type panel with two side covers, in which each includes a flat wall surface (2) that extends on a curved-concave surface (4') when it reaches the upper edge of the panel and that after a counter-curve joins the upper edge surface (3), in which the panel has a upper grooved groove (6*a*) on its upper edge to slide the panel (1) with respect to a top guide profile (7) fixed in the sky of the enclosure, where each side panel (1) cover is a half of post-formed cover (1*a*) of plastic material and in which the panel (1) comprises a perimeter profile (1*b*) that has grooved grooves (6*a*, 6*b*, 6*c*) centered and continuous by its outer edges, in which the halves of post-formed cover (1*a*) are joined by their inner surfaces to the perimeter profile (1*b*), leaving exposed the grooved grooves (6*a*, 6*b*, 6*c*) centered and continuous by their outer edges, in which the halves of post-formed cover (1*a*) are joined by their inner surfaces to the perimeter profile (1*b*), exposing the grooved grooves (6*a*, 6*b*, 6*c*) on the edges of the panel (1); and because the system further comprises: at least one intermediate support profile (8*a*) that is assembled on a support profile (8*b*) fixed to the floor by means of fasteners (10) to slide the panel (1) with its bottom grooved groove (6*b*) of the lower edge on projections on the upper edge of the intermediate support profile (8*a*), while sliding with respect to the upper guide profile (7); at least one connection profile (12) with central projections (12*c*) that assemble with the grooved grooves on the sides of each panel (1) for interleaved mounting; concave curvature profiles (9*a*) that are assembled on curve support profiles (9*b*) fixed to each side of the support profile (8*b*) to configure a concave and tangential curvature to the floor of the enclosure; and parts of corner encounters, in which each corner encounter part includes a concave corner post-formed cover (15), a convex corner post-formed cover (14), a set of edge profiles with cross-section equal to the perimeter profile (1*b*) that join both post-formed covers (14, 15) by their lateral, upper and lower edges for joining with the panels (1) through connection profiles (12).

The system further comprises a floor cover (11) of the enclosure that extends to adhere on the concave curvature profiles (9*a*) and on a portion of the intermediate support profiles (8*a*), so that the edge of the floor cover (11) establishes a continuous surface with each flat wall surface (2) of each panel.

In addition, the connection profile (12) comprises a flexible strip (12*a*) with its raised edges (12*b*) and central projections (12*c*) for assembly that extend along the flexible strip and symmetrically with respect to the plane of the flexible strip.

In particular, the central projections (12*c*) have a complementary shape to the grooved grooves (6*a*, 6*b*, 6*c*) of the panels, and allow tight assembly with the lateral grooved grooves (6*c*) on the side edges of the panels to be joined.

Following the above, the flexible strip (12*a*) has a width less than the separation distance of the flat wall surfaces (2) and the height of its raised edges (12*b*) is equal to the optimum spacing between adjacent panels to form a sealed joint (13) by the subsequent application of a joint sealing product.

In addition, the system is such that between the side covers and the perimeter profile (1*b*) an interior space for insulation is defined which comprises a filling material suitable for thermal, acoustic, fire insulation, among others, as required.

In another aspect of the system, the plastic material in which each half of post-formed cover (1*a*) is manufactured comprises one or more materials chosen from: acrylonitrile butadiene styrene (ABS), polymethylmethacrylate (PMMA), glass fibers or carbon dipped in thermostable resins.

Optionally, the system comprises, for electrical installations, water, oxygen, gas and compressed air includes at least one panel (1) provided with at least one rectangular hole located on a flat wall surface (2) and a tube that extends towards from the inside of said at least one rectangular hole and projecting beyond the upper edge of the panel through the perimeter profile (1*b*).

Optionally, the system comprises, at least one panel (1) has a large rectangular opening that crosses it and starts at the lower edge of the panel defining internal lateral and upper edges, in which the profiles (8*a*, 8*b*, 9*a*, 9*b*) that they are connected to the bottom of said panel (1) are cut to allow the rectangular opening to extend to the floor, and a frame with at least one door that fits and is fixed in the extended rectangular opening, where said frame and door have a thickness just like the panel.

Optionally the system comprises, at least one panel (1) with a closed rectangular opening that crosses it in an interior area of the panel, and a frame with a window that fits and is fixed in the closed rectangular opening, where said window has its window surfaces in the same plane of each flat wall surface (2) of the panel.

In another aspect, the system further comprises a panel crossing part, which includes four concave post-formed corner covers (15), a set of edge profiles with cross section equal to the perimeter profile (1*b*) that join the post-formed covers (15) by its adjacent side edges, upper and lower, for joining with panels (1) that converge at a junction through connection profiles (12).

With respect to the method of installing a clean room wall by means of a modular system of panels to form aseptic spaces inside an enclosure, according to any of the embodiments described above, the steps of: a) fixing an upper guide profile (7) are included to the sky of the enclosure by means of fasteners (10); b) fix a support profile (8*b*) to the floor without a cover and assemble an intermediate support profile (8*a*); c) position a panel (1) by sliding between the upper grooved groove (6*a*) and the upper guide profile (7) and between the bottom grooved groove (6*b*) and projections on the upper edge of the intermediate support profile (8*a*); d) intersperse mount a connection profile (12) with each panel (1), so that a tight assembly is established between one of the central projections (12*c*) of each connection profile (12) and one of the lateral grooved grooves (6*c*) of each panel (1), and so that the raised edges (12*b*) of the flexible strip (12*a*) of each connection profile (12) are fully fitted between the lateral edge surfaces (5) of adjacent panels; e) fix curve support profiles (9*b*) on each side of the support profiles (8*b*) and assemble concave curvature profiles (9*a*); f) extend the floor cover (11) and adhere it on the concave curvature profiles (9*a*) and on a portion of the intermediate support profiles (8*a*) that remains visible, so that the edge of the floor cover (11) establish a continuous surface with the flat wall surfaces (2) of each panel.

Furthermore, the step of intercalating a connection profile (12) with each panel (1) is carried out in such a way that a tight assembly is established between one of the central projections (12*c*) of each connection profile (12) and one of the lateral grooved grooves (6*c*) of each panel (1), and so that the raised edges (12*b*) of the flexible strip (12*a*) of each connection profile (12) are fully fitted between the lateral edge surfaces (5) of adjacent panels defining an optimal spacing slot between adjacent panels.

Next, the method comprises the step of applying a joint sealing product in the optimal spacing groove between adjacent panels to form the sealed joint (13).

PARTS LIST

1 panel (monolithic)
1*a* half of post-formed cover
1*b* perimeter profile
1*c* filler material
2 flat wall surface
2' flat portion (of the mold)
3 upper edge surface
3' upper edge portion (of the mold)
4 curved-concave surface (top edge)
4' curved-concave portion (of the mold)
5 lateral edge surfaces
5' lateral edge portions (of the mold)
6*a* upper grooved groove
6*b* bottom grooved groove
6*c* lateral grooved groove
7 upper guide profile
8*a* intermediate support profile (with a guide projection)
8*b* support profile
9*a* concave curvature profile
9*b* curve support profile
10 fasteners
11 floor cover
12 connection profile
12*th* flexible strip
12*b* raised edges
12*c* central projections
13 sealed joint
14 convex corner post-formed cover
15 concave corner post-formed cover

The invention claimed is:

1. A modular system of panels for forming aseptic spaces within an enclosure, comprising a rectangular parallelepiped type panel with two side covers, wherein each panel includes a flat wall surface that extends into a curved-concave surface at an upper edge of the panel and then continues in a counter-curve that joins an upper surface, where each side cover is half of a post-formed cover of plastic material and comprises a perimeter profile that has a perimeter groove centered and continuous along an outer edge, wherein the halves of the post-formed cover are joined by an inner surface to the perimeter profile, exposing the perimeter groove on an edge of the panel, wherein the perimeter groove has an upper groove on the upper surface of the panel, a bottom groove on a lower edge of the panel, and a side groove on a side of the panel, wherein the upper groove slides the panel with respect to an upper guide profile fixed in a ceiling of the enclosure; wherein the system further comprises:

at least one intermediate support profile assembled on a support profile fixed to a floor of the enclosure by means of fasteners to slide the panel on the bottom groove on a projection on an upper edge of the intermediate support profile, while sliding with respect to the upper guide profile;

at least one connection profile with a central projection that assembles with the side groove for interleaved mounting of panels;

a concave curvature profile assembled on a curve support profile fixed to each side of the support profile to configure a concave and tangential curvature to the floor of the enclosure; and a corner encounter part, which includes a concave corner post-formed cover, a convex corner post-formed cover, a set of edge profiles with a cross-section equal to the perimeter profile that join the corner post-formed covers by a side, upper, and bottom edge with the panels through connection profiles.

2. The modular system of panels of claim 1, further comprising a floor cover that extends to adhere on the concave curvature profile and on a portion of the intermediate support profiles, so that an edge of the floor cover establishes a continuous surface with the flat wall surface of each panel.

3. The modular system of panels of claim 1, wherein the connection profile comprises a flexible strip with a raised edge and the central projection extends along the flexible strip and symmetrically with respect to the plane of the flexible strip.

4. The modular system of panels of claim 3, wherein the central projection has a shape complementary to the side grooves of the panels, which allows tight assembly between the panels to be joined.

5. The modular system of panels of claim 3, wherein the flexible strip has a width less than a distance between the flat wall surfaces and a height of the raised edge is equal to an optimum spacing between adjacent panels to form a sealed joint by subsequent application of a joint sealing product.

6. The modular system of panels of claim 1, wherein between the side covers and the perimeter profile an interior space for insulation is defined that comprises a filling material suitable for at least one of thermal, acoustic, or fire insulation.

7. The modular system of panels of claim 1, wherein the plastic material of each half of the post-formed cover comprises at least one or more of acrylonitrile butadiene styrene (ABS), polymethylmethacrylate (PMMA), glass fibers or carbon dipped in thermostable resins.

8. The modular system of panels of claim 1, wherein for electrical, water, oxygen, gas, and compressed air installations, the system includes at least one panel provided with at least one rectangular hole located on the flat wall surface and a tube that extends upwards from an inside of the at least one rectangular hole and projects beyond the upper surface of the panel through the perimeter profile.

9. The modular system of panels of claim 1, wherein at least one panel has a large rectangular opening therethrough for a frame and a door, which starts at the lower edge of the panel defining an internal lateral edge and an internal upper edge, wherein the intermediate support profile, the support profile, the concave curvature profile, and the curve support profile connected to a bottom of the panel are cut to allow the large rectangular opening to extend to the floor, and the frame and the door are fixed in the large rectangular opening, where the frame and the door have a thickness equal to the panel.

10. The modular system of panels of claim 1, wherein at least one panel has a closed rectangular opening in an interior area of the panel for a frame and a window, and the frame and the window are fixed in the closed rectangular opening, where the window has a window surface in the same plane as the flat wall surface of the panel.

11. The modular system of panels of claim 1, further comprising a panel crossing part, which includes four concave corner post-formed covers, a set of edge profiles with a cross section equal to the perimeter profile that join the concave corner post-formed covers by an adjacent side, upper and lower edge with panels that converge at a junction through connection profiles.

12. A method of installing a clean room wall by means of a modular system of panels to form aseptic spaces inside an enclosure, comprising the steps of:

a) fixing an upper guide profile to a ceiling of the enclosure with fasteners;

b) fixing a support profile without a cover to a floor of the enclosure and assembling an intermediate support profile;

c) positioning a panel by sliding the panel between an upper groove and the upper guide profile and between a bottom groove and a projection on an upper edge of the intermediate support profile;

d) intercalating a connection profile with a central projection with a side groove on a side of each panel;

e) fixing a curve support profile on each side of the support profile and assembling a concave curvature profile; and f) extending a floor cover and adhering the floor cover to the concave curvature profile and on a portion of the intermediate support profile that remains visible, so that an edge of the floor cover establishes a continuous surface with a flat wall surface of each panel.

13. The method of claim 12, wherein the step of intercalating a connection profile with each panel comprises tightly assembling the central projection of the connection profile and the side groove of each panel, so that a raised edge of a flexible strip of the connection profile is fully fitted between lateral edge surfaces of adjacent panels defining optimal spacing between adjacent panels.

14. The method of claim 13, further comprising the step of:

g) applying a joint sealing product in the optimal spacing between adjacent panels to form a sealed joint.

* * * * *